US006641744B1

(12) United States Patent
Kawamura et al.

(10) Patent No.: US 6,641,744 B1
(45) Date of Patent: Nov. 4, 2003

(54) METHOD OF FORMING PILLARS IN A FULLY INTEGRATED THERMAL INKJET PRINTHEAD

(75) Inventors: Naoto Kawamura, Corvallis, OR (US); David R Thomas, Corvallis, OR (US); David J Waller, Corvallis, OR (US); Timothy L Weber, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 175 days.

(21) Appl. No.: 09/668,627

(22) Filed: Sep. 22, 2000

Related U.S. Application Data

(62) Division of application No. 09/178,194, filed on Oct. 23, 1998, now Pat. No. 6,309,054.

(51) Int. Cl.[7] ..... B41J 2/04

(52) U.S. Cl. ..... 216/27; 216/17; 216/19; 216/41; 347/65

(58) Field of Search ..... 216/17, 19, 41, 216/27; 347/65

(56) References Cited

U.S. PATENT DOCUMENTS 4,894,664 A 1/1990 Tsung Pan ..... 347/163
5,204,280 A * 4/1993 Dhong et al. ..... 438/386
5,463,413 A 10/1995 Ho et al. ..... 347/65
5,569,355 A * 10/1996 Then et al. ..... 216/24
5,734,399 A 3/1998 Weber et al. ..... 347/65
5,751,315 A * 5/1998 Burke et al. ..... 347/62
5,959,322 A * 9/1999 Lee ..... 257/296

FOREIGN PATENT DOCUMENTS

EP 0500068 A2 8/1992 ..... B41J/2/175

* cited by examiner

*Primary Examiner*—Benjamin L. Utech
*Assistant Examiner*—Shamim Ahmed

(57) ABSTRACT

Pillars are formed in a fully integrated thermal inkjet printhead to prevent particles from entering into a nozzle chamber along an ink refill channel. The pillars are formed after a step of applying a thin film structure to a substrate. At one step, pits are etched through the thin film structure. At another step, material for an orifice layer is deposited into the pits. At another step, a firing chamber is etched into the orifice layer. At another step, a trench is etched into the backside of the wafer in the vicinity of the filled pits. The material filling each pit is not removed and remains in place to define the respective pillars. Two or more pillars are formed within the trench for each inkjet nozzle chamber. Alternatively pillars are formed by depositing material into the underside trench and performing photoimaging processes.

9 Claims, 7 Drawing Sheets

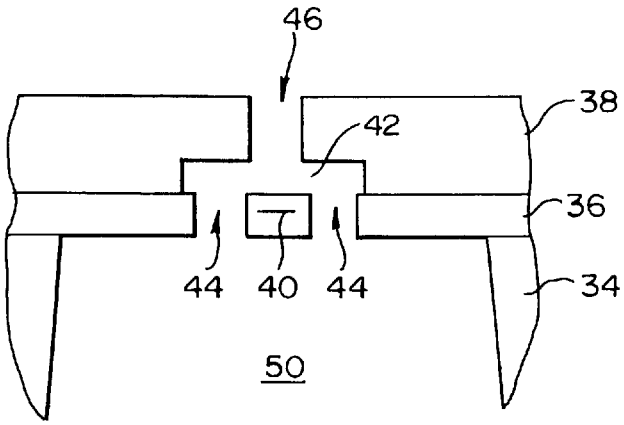
FIG. 8
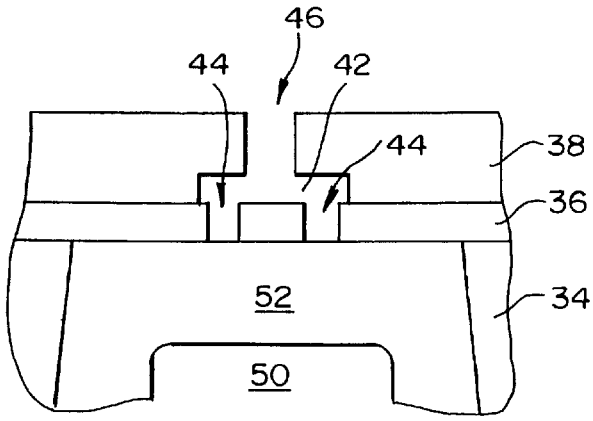
FIG. 9
FIG. 10
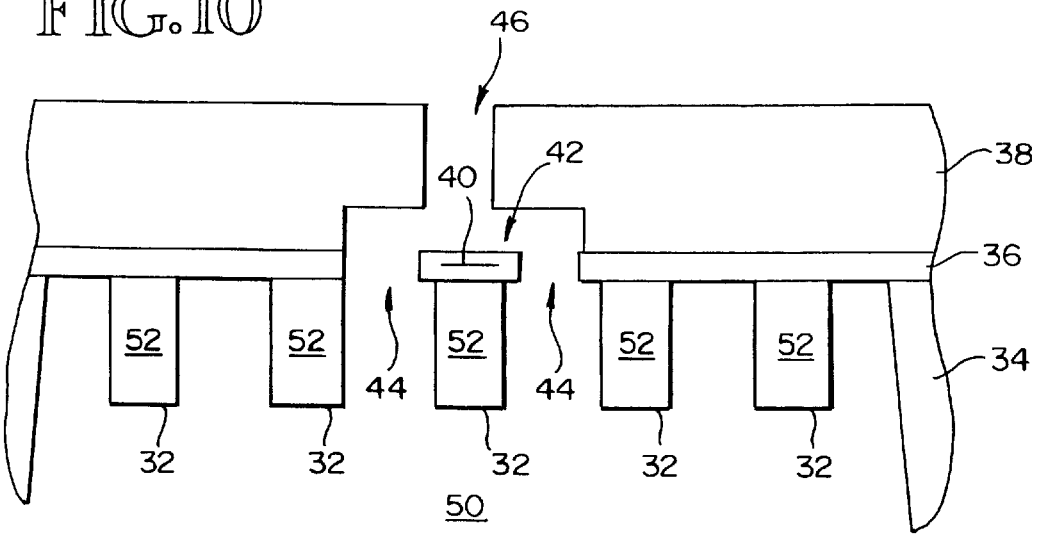

FIG. 11
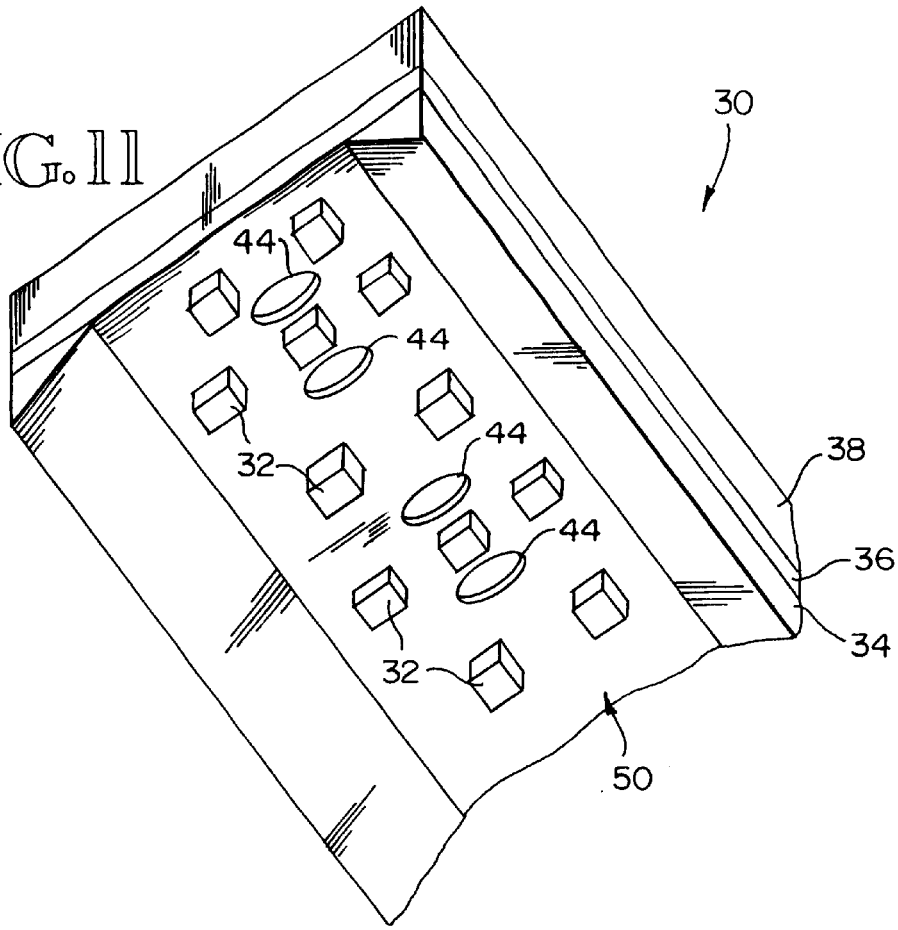
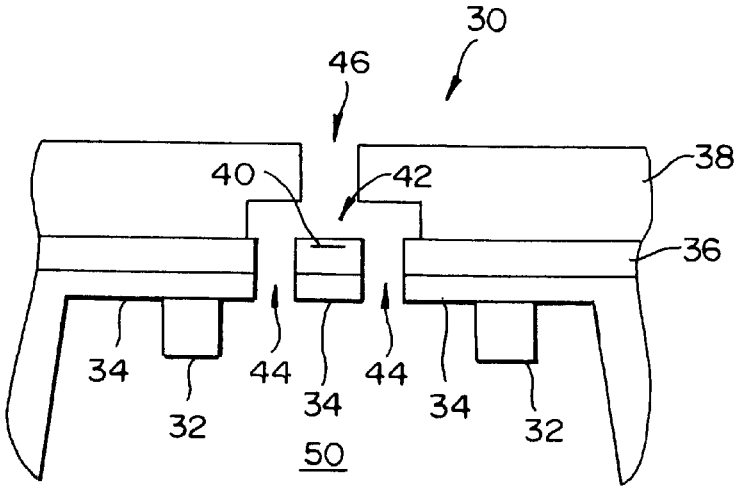
FIG. 12

FIG. 13
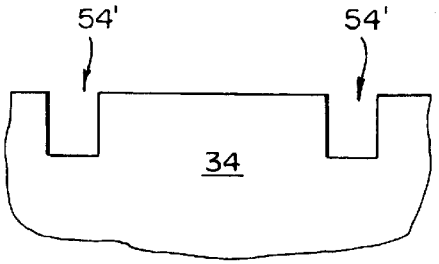
FIG. 14
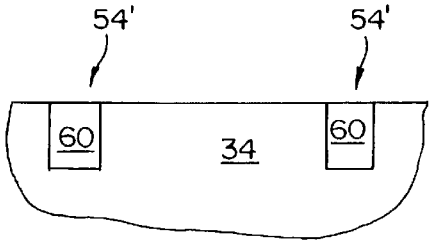
FIG. 15
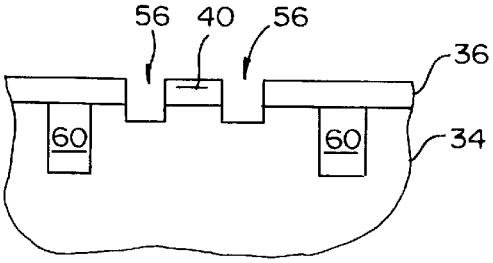
FIG. 16
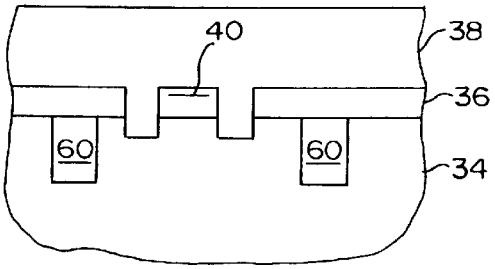
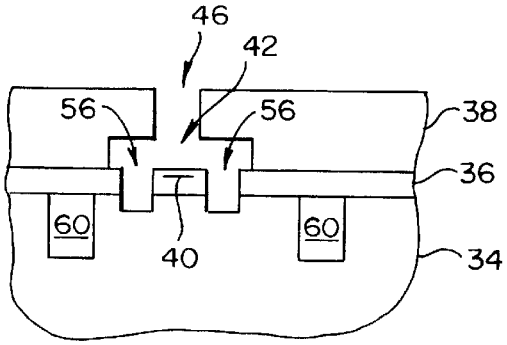
FIG. 17
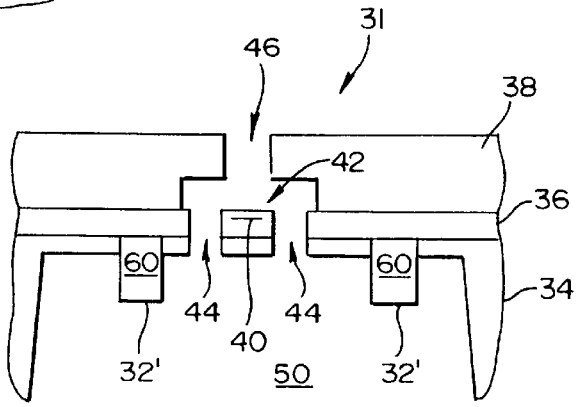
FIG. 18

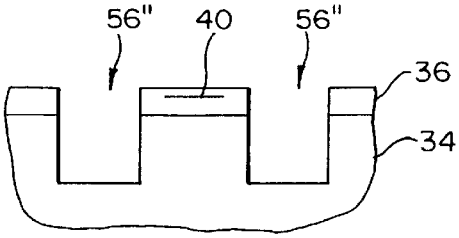
FIG. 19
FIG. 20
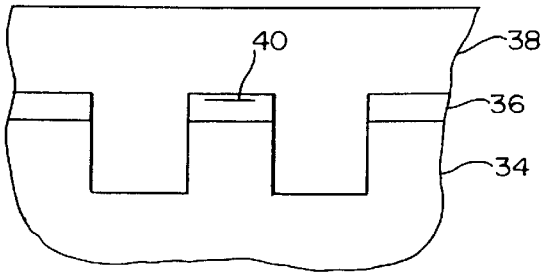
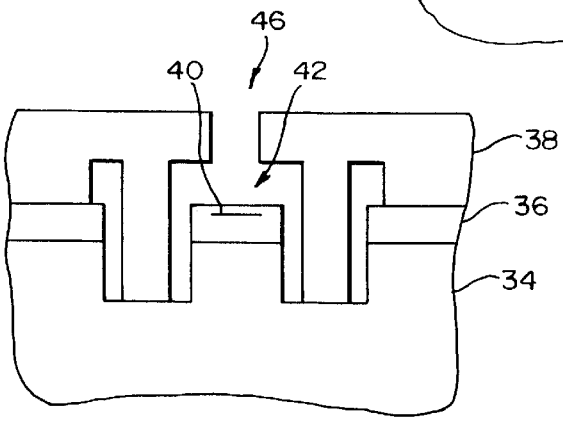
FIG. 21
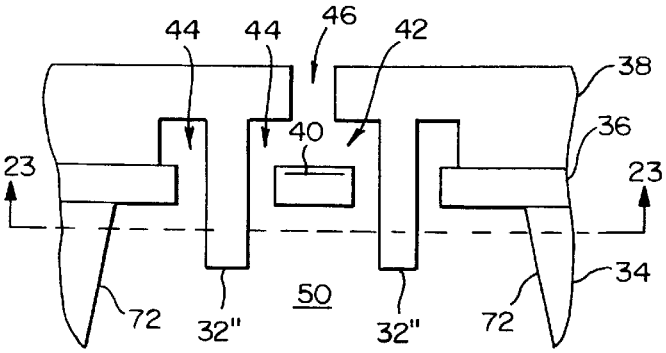
FIG. 22
FIG. 23
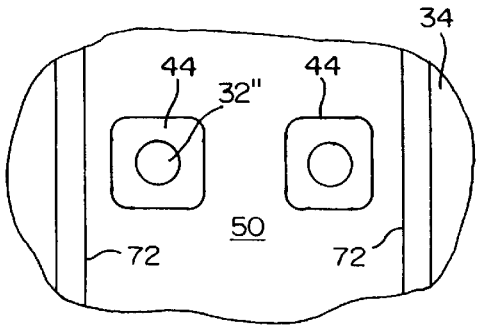

METHOD OF FORMING PILLARS IN A FULLY INTEGRATED THERMAL INKJET PRINTHEAD

CROSS REFERENCE TO RELATED APPLICATION

This is a divisional of U.S. patent application Ser. No. 09/178,194 filed Oct. 23, 1998, now U.S. Pat. No. 6,309,054 for "Method of Forming Pillars in a Fully Integrated Thermal Inkjet Printhead," of Kawamura et al., the content of which is incorporated herein by reference and made a part hereof.

This invention is related to the subject matter disclosed in commonly assigned U.S. patent application Ser. No. 09/033,987 filed Mar. 3, 1998 now U.S. Pat. No. 6,162,589 for "Direct Imaging Polymer Fluid Jet Orifice," of Chen at al., the content of which is incorporated herein by reference and made a part hereof.

BACKGROUND OF THE INVENTION

This invention relates generally to a method for fabricating a fully integrated (monolithic) inkjet printhead, and more particularly to a method for forming pillars within the printhead to reduce particle clogging of ink refill channels.

A thermal inkjet printhead is part of an inkjet pen. The inkjet pen typically includes a reservoir for storing ink, a casing and the inkjet printhead. The printhead includes a plurality of nozzles for ejecting ink. A nozzle operates by rapidly heating a small volume of ink in a nozzle chamber. The heating causes the ink to vaporize and be ejected through an orifice onto a print medium, (e.g., a sheet of paper). Properly sequenced ejection of ink from numerous nozzles arranged in a pattern causes characters, symbols or other graphics to be printed on the print medium as the printhead moves relative to the print medium.

The inkjet printhead includes one or more refill channels for carrying ink from the reservoir into respective nozzle chambers. According to one conventional fabrication methodology, a nozzle chamber is defined in a barrier layer applied to a substrate. An orifice plate is applied to the barrier layer. The substrate forms a floor of the firing chamber (along with a firing resistor), while the orifice plate forms a ceiling to the firing chamber. According to another conventional fabrication methodology, a fully integrated, or monolithic, printhead of inkjet nozzles is formed using photoimaging techniques similar to those used in semiconductor device manufacturing. The fully integrated thermal (FIT) inkjet printhead includes a thin film layer formed of various passivation, insulation, resistive and conductive layers applied to a silicon wafer.

One problem which affects print quality is clogging of the ink refill channels. Once a nozzle chamber is fired ejecting a drop of ink, ink flows from the reservoir through the ink refill channels into the nozzle chambers. Typically, the ink is stored within a porous material filling the reservoir to achieve fluid retention and fluid pressure benefits. A disadvantage of the porous material, however, is that particles are occasionally disengaged and carried by the ink into the ink refill channels. Even for devices without a porous material in the ink reservoir, particles remaining from manufacturing processes may be carried by ink to the refill channels. Such porous material particles or leftover manufacturing process particles can become lodged and block a refill channel. Blocking of a refill channel can cause premature failure of an inkjet firing chamber, or cause ink starvation of the inkjet firing chamber. The failure of a nozzle to eject an ink droplet can harm print quality. Redundant nozzles have been proposed and implemented as one solution to this problem.

Pillars and barrier islands have been proposed to capture particles and provide redundant pathways leading to the nozzle chambers. U.S. Pat. No. 5,463,413 issued Oct. 31, 1995 to Ho et al. for "Internal support for Top-Shooter Thermal Inkjet Printhead" discloses pillars for a printhead formed by a substrate, barrier layer and orifice plate. U.S. Pat. No. 5,734,399 issued Mar. 31, 1998 to Weber et al. for "Particle Tolerant Inkjet Printhead Architecture" discloses barrier islands for a printhead also formed by a substrate, barrier layer and orifice plate. Both of these patents disclose forming the pillars or barrier islands in the barrier layer before applying the orifice plate.

SUMMARY OF THE INVENTION

According to the invention, pillars are formed in a fully integrated thermal inkjet printhead to prevent particles from entering into a nozzle chamber along an ink refill channel. Ink can flow into the nozzle chamber even in the presence of a particle blocking one of multiple ink refill channels leading to the nozzle chamber.

According to one aspect of the invention, the pillars are formed after a step of applying a thin film structure to a printhead substrate. The thin film structure includes various passivation, insulation, resistive and conductive layers applied to the substrate using photoimaging and deposition techniques.

According to another aspect of the invention, pits are etched through the thin film structure into the wafer at one step. Ink feed holes are etched through the thin film structure and into the wafer, concurrently or during a separate step. At another step, material for an orifice layer is deposited into the pits and holes and onto the thin film structure. At another step, a firing chamber is etched into the orifice layer. During this step material is removed from the ink feed holes. At another step, a trench is etched into the backside of the wafer in the vicinity of the filled pits and the ink feed holes. The material filling each pit is not removed and remains in place to define the respective pillars. Two or more pillars are left protruding within the backside trench in the vicinity of the inlet channels for a corresponding nozzle chamber.

According to another aspect of the invention, an alternative fabrication process is used to from the pillars. After the thin film structure is applied, ink feed holes are etched into the thin film structure down into the substrate. Material for an orifice layer then is deposited into the holes and onto the thin film structure. A firing chamber then is etched into the orifice layer. During the etching of the firing chamber material is removed from the ink feed holes. At another step, a trench is etched into the backside of the wafer in the vicinity of the ink feed holes. After the trench is formed, a conforming layer of photoimagable material is spun into the trench along the backside of the substrate and thin film structure. At another step, an alignment and exposure process are performed to define an array of pillars within the trench. After the exposure, a developing process is performed to remove unwanted material and leave the pillars in place. The pillars are formed within the trench. Such pillars are formed on the underside of the thin film structure or on the backside of the substrate. In an alternative procedure, the pillars are formed before the orifice layer is deposited and the nozzle chamber is formed. One advantage of the photoimaging methodology embodiment is that the pillars can be formed to precise size and shape at desired locations.

According to another aspect of the invention, the pillars are formed prior to the step of applying the thin film structure to the printhead substrate. Pits are etched into the wafer at one step. At another step the pits are filled with a backside etchant-resistant material. The substrate then is planarized and fabrication continues with the deposition of the thin film layer and the orifice layer. The firing chamber, inlet channels and backside trench then are etched. During etching of the backside trench the etchant-resistant material filling the pits remains. Such material protrudes within the trench as the pillars. Two or more pillars are left protruding within the backside trench in the vicinity of inlet channels for a corresponding nozzle chamber.

One advantage of the invention is that pillars form a barrier 'reef' which keeps particles away from ink feed holes of nozzle chambers. Thus, fluid is able to flow into the nozzle chambers even in the presence of particles. Another advantage of the pillars is that ink drop weight is substantially unaffected and overshoot during refill is slightly reduced. A slight decrease in refill frequency is evident, however. These and other aspects and advantages of the invention will be better understood by reference to the following detailed description taken in conjunction with the accompanying drawings.

BRIEF DESCRIPTION OF THE DRAWINGS

FIG. 8 is a planar view of a substrate in process for an alternative method of this invention;

FIG. 9 is a planar view of the substrate in process of FIG. 8 after applying a photoimagable material into a backside trench;

FIG. 10 is a planar view of a fabricated substrate portion for the alternative method of this invention;

FIG. 11 is a perspective view of the underside of a portion of the fabricated printhead of FIG. 2 or 10;

FIG. 12 is a planar view of a fabricated substrate portion for a variation of the alternative method of this invention;

FIG. 13 is a planar view of a substrate in process after etching pillar openings according to another alternative method of this invention;

FIG. 14 is a planar view of the substrate in process after depositing material into the openings of FIG. 13;

FIG. 15 is a planar view of the substrate in process of FIG. 14 after applying the thin film structure and etching inlet channel openings;

FIG. 16 is a planar view of the substrate in process after deposition of an orifice layer;

FIG. 17 is a planar view of the substrate in process after etching out a nozzle firing chamber and the inlet channel openings;

FIG. 18 is a planar view of a fabricated substrate portion after etching a trench and revealing the pillars; and FIG. 19 is a planar view of a substrate in process after deposition of a thin film structure and etching of openings according to another alternative method of this invention;

FIG. 20 is a planar view of the substrate in process of FIG. 19 after depositing an orifice layer;

FIG. 21 is a planar view of the substrate in process of FIG. 20 after etching a nozzle firing chamber;

FIG. 22 is a planar view of a fabricated substrate portion after etching a trench and revealing the pillars of FIG. 21;

FIG. 23 is a planar bottom view of the substrate portion of FIG. 22 taken along line 23—23.

DESCRIPTION OF SPECIFIC EMBODIMENTS

Overview

Figure 1:
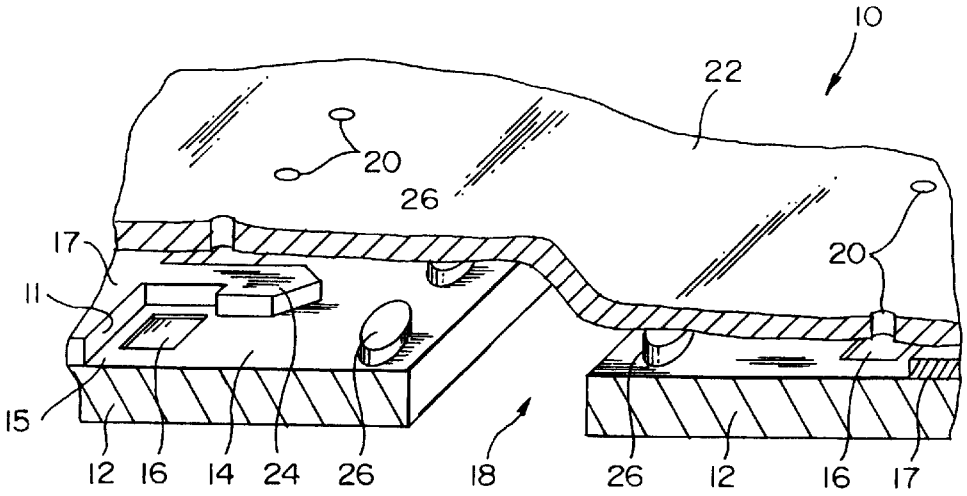
FIG. 1 PRIOR ART
FIG. 1 is an exploded view of a portion of a conventional inkjet printhead.

FIG. 1 shows a portion of a conventional inkjet printhead 10 including a plurality of inkjet nozzle printing elements 11, formed on a substrate 12. Each nozzle 11 includes a barrier inlet channel 14 with a resistor 16 situated at one end of the channel 14 within a firing chamber 15. The barrier inlet channel 14 and firing chamber 15 are formed in a barrier layer 17 made of a photopolymerizable material which is appropriately masked and developed to form a desired patterned opening. A pair of projections 24 are formed in the walls of the barrier layer 17 at the entrance to each inlet channel 14, separated by a width to define the inlet channel width.

Ink (not shown) is introduced from an ink feed channel 18 at the opposite end of the inlet channel 14 away from the resistor 16. The ink feed channel 18 passes through the substrate 12 and is provided with a continuous supply of ink from an ink reservoir (not shown) located beneath the substrate 12. Associated with each resistor 16 is a nozzle opening 20, located near the resistor 16 in the adjacent orifice plate 22.

A plurality of elliptical pillars 26 are included in the barrier layer 17 along the edge of the ink feed channel 18 near the entrance of the inlet channels 14. The pillars 26 are formed during the processing of the barrier layer 17, and thus are formed concurrently with the inlet channels 14 and firing chambers 15. Each pillar is the same height as the barrier layer 17. The major axis of each pillar 26 is perpendicular to the ink flow from feed channel 18 into the inlet channels 14. The pillars 26 serve to filter out internal particles from the ink reservoir before the particles reach the inlet channels 14 and possibly clog one or more inlet channels 14.

Figure 2:
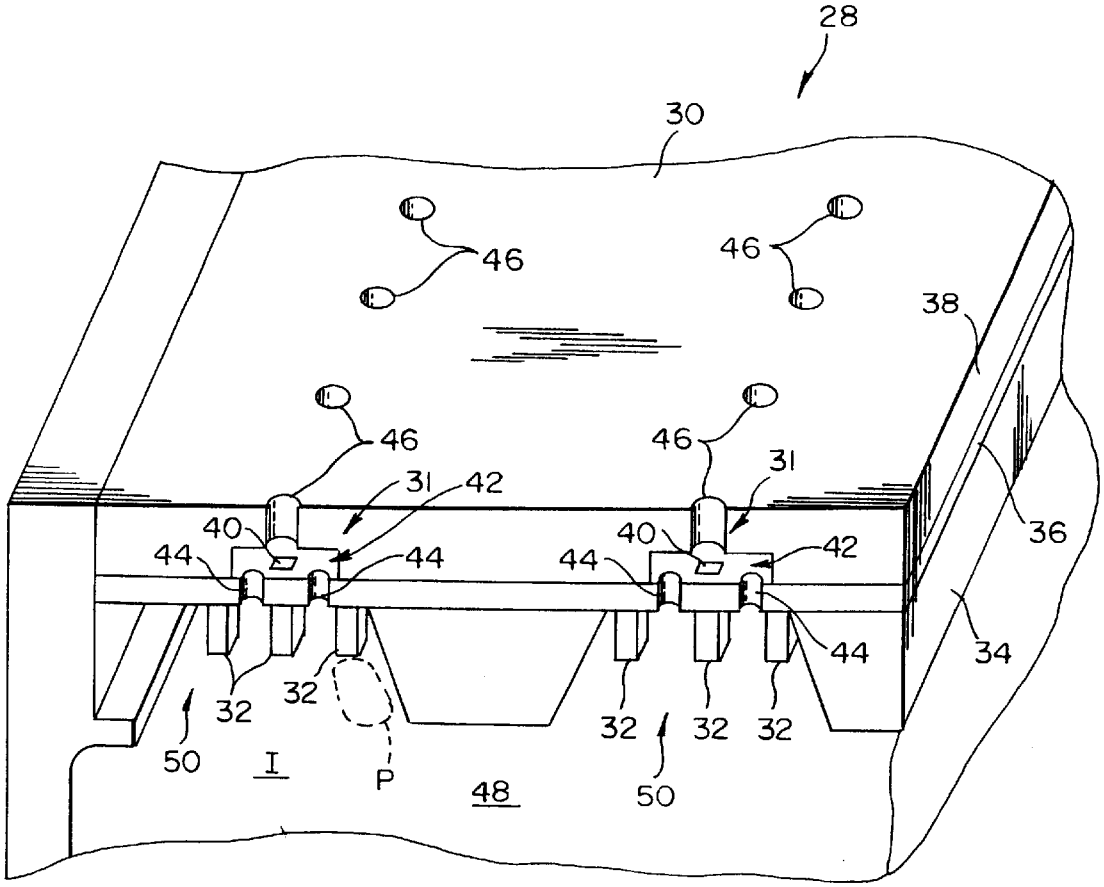
FIG. 2 is a partial perspective view of a portion of an inkjet pen including a printhead fabricated according to a method embodiment of this invention.

FIG. 2 shows a portion of an inkjet pen 28 having a fully integrated thermal (FIT) inkjet printhead 30. The FIT printhead 30 is formed by a substrate 34, a thin film structure 36 and an orifice layer 38, and includes a plurality of nozzle printing elements 31. The substrate 34 includes a front surface and an opposing back surface. Formed on the front surface are a plurality of firing chambers 42. Formed into the back surface is an ink feed channel 50 that is in fluid communication with the firing chamber 42 through inlet channels 44.

The thin film structure 36 includes various passivation, insulation, resistive and conductive layers applied to the substrate 34. A resistor 40 is formed in the thin film structure 36 for each nozzle printing element 31. Associated with each printing element 31 is the firing chamber 42, one or more ink inlet channels 44, and an outlet orifice 46.

Ink I originating from a reservoir 48 is introduced into the firing chamber 42 from an ink feed channel 50 and the inlet channels 44. The substrate 34 also includes a plurality of barrier members 32 positioned to prevent particles P from reaching the inlet channels 44 or the firing chambers 42. In a preferred embodiment, the barrier members 32 are pillars which are positioned in the ink feed channel 50 adjacent to each of the inlet channels 44. Preferably, the pillars 32 are formed on a back surface of the substrate and extend in a direction substantially opposite to the flow direction of ink through the inlet channels 44.

For typical particle sizes, it was found in simulation that ink drop weight remains essentially the same when the barriers 32 are included. It also was found that ink refill overshoot was slightly reduced as the pillars appear to provide additional damping. Ink refill frequency, however, decreased slightly as it takes a slightly longer period to refill the nozzle firing chambers 42. The height of the pillars 32 may vary. These experimental results were achieved in an exemplary embodiment in which a lower portion of the firing chamber 42 is 42 microns×26 microns with a height of 9 microns, and the upper portion is 16 microns in diameter and 3 microns thick. Corresponding inlets 44 are ovular at 7 microns by 22 microns, while the resistor 40 is 7 microns by 14 microns. With pillars of either 6 microns or 12 microns in height, particles for achieving the experimental results were 13 microns and 16 microns. Of course, one skilled in the art will appreciate that the specific dimensions of the firing chamber 42, inlets 44, resistor 40 and pillars 32 may vary.

Method of Fabrication—Pillars Formed with Orifice Material

Figure 3:
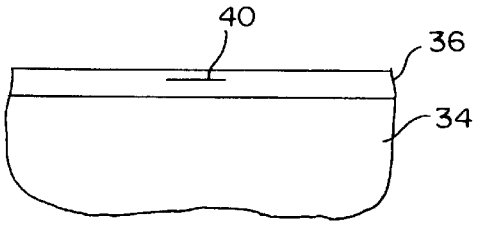
FIG. 3 is a planar view of a substrate in process after deposition of a thin film structure.

Referring to FIG. 3, a semiconductor wafer 34 (e.g., silicon) is processed to receive a thin film structure 36. The thin film structure 36 includes various passivation, insulation, resistive, and conductive layers applied to the wafer 34 using known semiconductor fabrication processes (e.g., deposition, photoimaging, etching, and planarizing processes). An array of resistors 40 is formed in the thin film structure 36 including wiring lines for carrying currents to energize the resistors 40.

Figure 4:
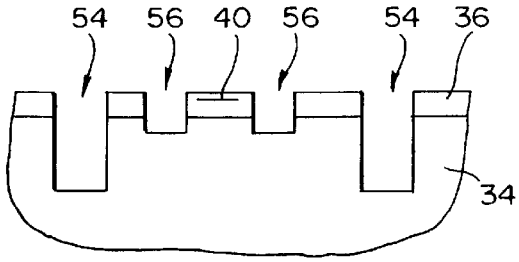
FIG. 4 is a planar view of a substrate in process after etching of pillar openings.

After the thin film structure 36 is applied, a plurality of openings are etched into the thin film structure 36 and wafer 34. For example, a photoresist and masking process are performed to define a mask for the openings. An exposure and developing process followed by the etching process results in a plurality of openings as shown in FIG. 4. In one embodiment both pillar openings 54 and inlet channel openings 56 are formed during a common etching process. In another embodiment, separate etching processes are performed to etch the pillar openings 54 to one depth and the inlet openings 56 to another depth. In one embodiment the pillar openings 54 are formed within the inlet channel opening to a deeper depth of the substrate 34.

Figure 5:
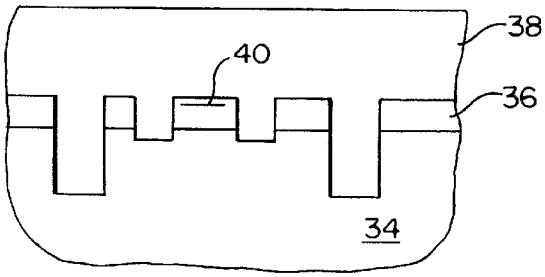
FIG. 5 is a planar view of a substrate in process after deposition of an orifice layer.
Figure 6:
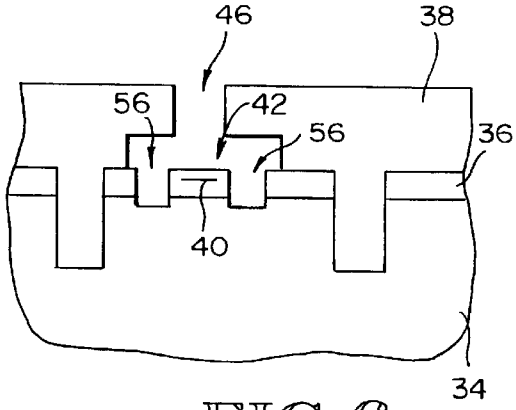
FIG. 6 is a planar view of a substrate in process after etching of a nozzle firing chamber.

Referring to FIG. 5, an orifice layer 38 is deposited to fill in the openings 54, 56 and overlay the thin film structure 36. A deposition process is used which assures that the deposited material conforms to the shape of the openings 54, 56. At another step as shown in FIG. 6, the firing chamber is etched from the orifice layer 38. During this etching step, the material filling the inlet openings 56 is removed. In a preferred embodiment, photodefinable material is applied and exposed to enable the etching process to define the firing chamber and etch out the material filling the inlet openings. In another embodiment, the firing chamber 42 is formed by first applying a mandrel to the thin film structure 36 before applying the orifice layer 38. The mandrel defines the shape of the firing chamber. The orifice layer is applied around the mandrel. The mandrel also fills the inlet openings 56 (rather than the orifice layer material). The mandrel material then is etched away to leave the firing chamber 42 and inlet openings 56.

At another step, a trench 50 is etched into the backside of the wafer 34. The etching process leaves the orifice layer material in what previously (see FIG. 4) were the pillar openings 54. Such material now defines the pillars 32. The etching process removes the substrate material exposing the inlet openings, which now define the inlet channels 44. The end result is a trench 50 having a plurality of pillars 32. Ink flows from the reservoir into the trench to the inlet channels 44. Particles inadvertently flowing with the ink are blocked by the pillars 32. The pillars 32 prevent such particles from blocking an inlet channel 44. Thus, ink flows into a nozzle chamber 42 even in the presence of a nearby particle.

Alternative Method of Fabrication—Backside Spinning

According to an alternative method of forming the pillars 32, a backside spinning process is used. At one step, the semiconductor wafer 34 (e.g., silicon) is processed to receive the thin film structure 36, as described above (see FIG. 3). Thereafter, the pillars 32 may be formed or the firing chambers 42 may be formed. Either can be formed first.

Referring to FIGS. 8–10, a method is described in which the firing chambers 42 are formed before the pillars 32. After the thin film structure 36 is applied, a plurality of inlet openings 44.are etched into the thin film structure 36 and wafer 34 (like in the FIG. 4 embodiment, but without the pillar openings 54). For example, a photoresist and masking process are performed to define a mask for the openings. An exposure and developing process followed by the etching process results in the plurality of openings 44 (as for openings 56 shown in FIG. 4). At another step, the orifice layer 38 is deposited into the openings 44 and onto the thin film structure 36 (similar to the process of FIG. 5). The firing chamber 42 then is etched from the orifice layer as described above for the prior embodiment of FIG. 6. The orifice material is removed from the openings 44 in the same step. At another step, a trench 50 is etched into the backside of the wafer 34 as shown in FIG. 8. FIG. 8 shows the substrate in process after the firing chamber 42 and the trench 50 are formed.

Referring to FIG. 9, a conformable photoimagable material 52 then is spun onto the backside of the wafer 34 within the trench 50. At another step a masking alignment and exposure process is performed to define where the pillars are to occur. Referring to FIG. 10, a developing process then removes the unwanted photoimagable material 52 leaving material 52 only where the pillars 32 are located. Such remaining material 52 defines the pillars 32. One benefit of this imaging method of forming the pillars is that it is easy and simple to design pillars to a desired shape and size. FIG. 11 shows the underside of a fabricated inkjet printhead 30. Ink flows from a reservoir into the trench 50 to the inlet channels 44. Particles inadvertently flowing with the ink are blocked by the pillars 32. The pillars 32 prevent such particles from blocking an inlet channel 44. Thus, ink flows into a nozzle chamber 42 even in the presence of a nearby particle. The pillars are formed in a pattern that substantially surrounds each of the inlet channels 44.

Although the figures illustrate formation of the firing chamber 42 before the pillars 32, the firing chamber instead may be formed after the pillars. For example, the backside trench 50 may be etched and the pillars formed before an orifice layer is applied to the thin film structure 36. The firing chamber then is formed in the orifice layer 38.

Method of Fabrication—Pillar Material Deposited before Thin Film Layer

Referring to FIG. 13, pits or openings 54' are etched into in a semiconductor wafer 34 (e.g., silicon) at one step. At subsequent steps, a backside etchant-resistant material 60 is deposited into the openings 54' and the substrate 34 is planarized (see FIG. 14). Exemplary backside etchant-resistant materials 60 include, but are not limited to, PSG, BPSG and Sol-Gels. At another step, the thin film structure 36 is applied to the substrate 34 at the same surface side as the filled in pits 54'. The thin film structure 36 includes various passivation, insulation, resistive, and conductive layers applied to the wafer 34 using known semiconductor fabrication processes (e.g., deposition, photoimaging, etching, and planarizing processes). An array of resistors 40 is formed in the thin film structure 36 including wiring lines for carrying currents to energize the resistors 40.

After the thin film structure 36 is applied, a plurality of openings 56 are etched into the thin film structure 36 and wafer 34. For example, a photoresist and masking process are performed to define a mask for the openings. An exposure and developing process followed by the etching process results in a plurality of openings as shown in FIG. 15.

Referring to FIG. 16, an orifice layer 38 is deposited to fill in the openings 56 and overlay the thin film structure 36. A deposition process is used which assures that the deposited material conforms to the shape of the openings 56. At another step as shown in FIG. 17, the firing chamber 42 is etched from the orifice layer 38. During this etching step, the material filling the inlet openings 56 is removed. In a preferred embodiment, photoresistive material is applied and exposed to enable the etching process to define the firing chamber and etch out the material filling the inlet openings.

At another step, a trench 50 is etched into the backside of the wafer 34. Referring to FIG. 18, the etching process leaves the etchant-resistant material 60 in what previously were the pillar openings 54'. Such material now defines the pillars 32'. The etching process removes the substrate material exposing the inlet openings, which now define the inlet channels 44. In the embodiment shown, a portion of the substrate 34 remains within the trench to define the floor/roof of the trench 50. In another embodiment the floor/roof of the trench 50 is the thin film structure 36. The end result is a trench 50 having a plurality of pillars 32'. Ink flows from the reservoir into the trench to the inlet channels 44 of printing elements 31. Particles inadvertently flowing with the ink are blocked by the pillars 32'. The pillars 32' prevent such particles from blocking an inlet channel 44. Thus, ink flows into a nozzle chamber 42 even in the presence of a nearby particle.

Method of Fabrication—Pillar Formed in Inlet Channel Opening

Referring to FIG. 19, a semiconductor wafer 34 (e.g., silicon) is processed to receive a thin film structure 36. The thin film structure 36 includes various passivation, insulation, resistive, and conductive layers applied to the wafer 34 using known semiconductor fabrication processes (e.g., deposition, photoimaging, etching, and planarizing processes). An array of resistors 40 is formed in the thin film structure 36 including wiring lines for carrying currents to energize the resistors 40. After the thin film structure 36 is applied, a plurality of inlet channel openings 56" are etched into the thin film structure 36 and wafer 34. For example, a photoresist and masking process are performed to define a mask for the openings. An exposure and developing process followed by the etching process results in a plurality of openings as shown in FIG. 19.

Referring to FIG. 20, an orifice layer 38 is deposited to fill in the openings 56" and overlay the thin film structure 36. A deposition process is used which assures that the deposited material conforms to the shape of the openings 56". At another step as shown in FIG. 21, the firing chamber 42 is etched from the orifice layer 38. During this etching step, the a portion of the material filling the inlet openings 56" is removed, while leaving material in place to serve as the pillars. In a preferred embodiment, photodefinable material is applied and exposed to enable the etching process to define the firing chamber 42 and etch out the material filling the inlet openings 56", while leaving in the material for the pillars. In an exemplary photodefinition process, one dosage is used to define the orifice layer material to be left in place, while a second dosage is used to define the orifice layer material to be removed. The development/etching step then removes the orifice layer material to create the nozzle chamber and ink inlet channel, while leaving the pillars. A method for creating a nozzle chamber by such a development process is described in commonly assigned U.S. patent application Ser. No. 09/033,987 filed Mar. 3, 1998 for "Direct Imaging Polymer Fluid Jet Orifice," of Chen at al., the content of which is incorporated herein by reference and made a part hereof.

At another step, a trench 50 is etched into the backside of the wafer 34. The etching process leaves the orifice layer material defining the pillars 32" (see FIGS. 22 and 23). The pillars 32" extend from the orifice layer at one border of the firing chamber 42 through the inlet channel openings 44 into the trench 50. The etching process removes the substrate material exposing the inlet openings 44 and the pillars 32". The end result is a trench 50 having a plurality of pillars 32". Ink flows from the reservoir into the trench 50 to the inlet channels 44. Particles inadvertently flowing with the ink are blocked by the pillars 32". The pillars 32" prevent such particles from blocking an inlet channel 44. Thus, ink flows into a nozzle chamber 42 even in the presence of a nearby particle.

Printing System

Figure 24:
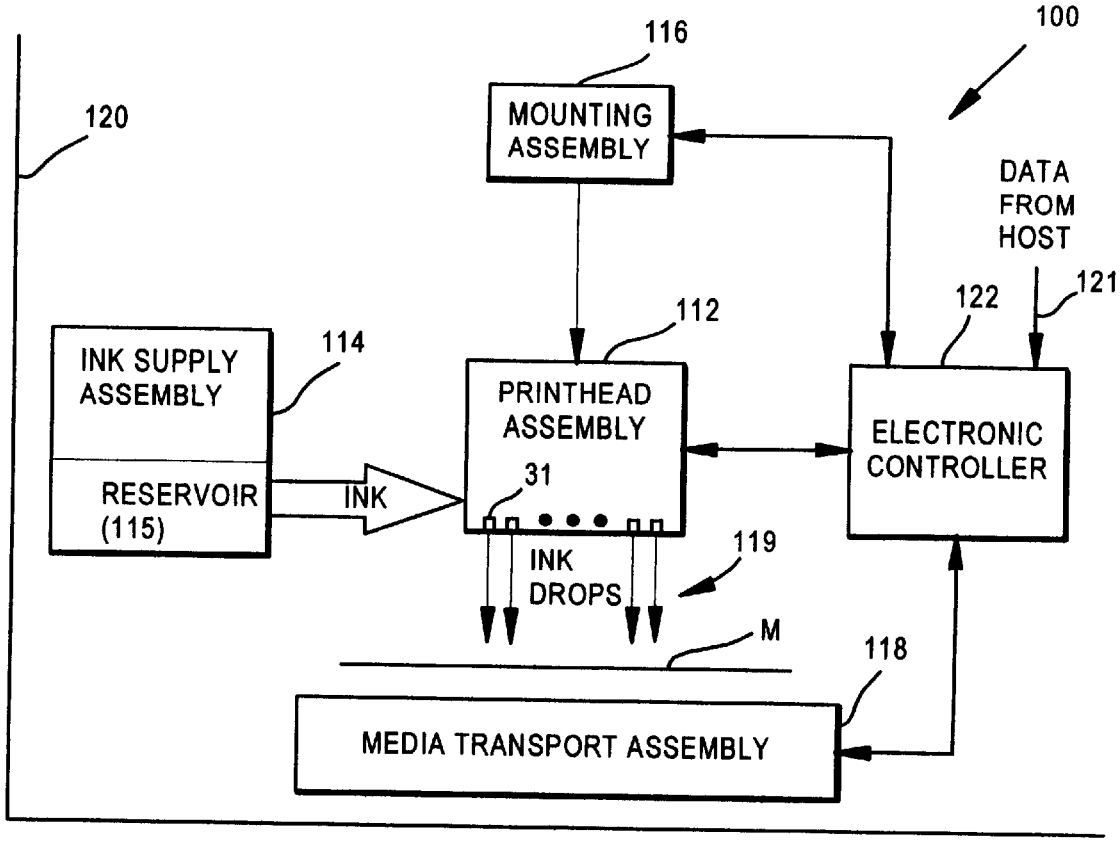
FIG. 24 is a block diagram of an inkjet printing system according to an embodiment of this invention.

Referring to FIG. 24, a thermal inkjet printing system 100 includes an inkjet printhead assembly 112, an ink supply assembly 114, a mounting assembly 116, a media transport assembly 118, a housing 120 and an electronic controller 122. The inkjet printhead assembly 112 is formed according to an embodiment of this invention, and includes one or more printheads having a plurality of inkjet nozzles 31 which eject ink onto a media sheet M. The printhead assembly 112 receives ink from the ink supply assembly 114. The ink supply assembly 114 includes a reservoir 115 for storing the ink. The ink supply assembly 114 and printhead assembly 112 form either a one-way ink delivery system or a recirculating ink delivery system. For the recirculating ink delivery system, ink flows from the reservoir into the printhead assembly. Some of the ink travels into printhead dies and nozzle chambers, while other portions of ink return to the ink reservoir.

In some embodiments the ink supply assembly 114 and inkjet printhead assembly 116 are housed together in an inkjet pen or cartridge. In other embodiments the ink supply assembly 114 is separate from the inkjet printhead assembly 112 and feeds ink to the printhead assembly through an interface connection, such as a supply tube. For either approach the ink supply may be removed, replaced and/or refilled. For example, in an inkjet pen having an internal reservoir, the pen may be disassembled and the internal reservoir removed. A new, filled reservoir then is placed within the pen, and the pen reassembled for re-use. Alternatively, the prior reservoir may be refilled and reinstalled in the pen or filled in place without removal from the pen (an in some embodiments without even disassembling the pen). In some embodiments there is a local reservoir within the pen along with a larger reservoir located separate from the pen. The separate reservoir serves to refill the local reservoir. In various embodiments, the separate reservoir and/or the local reservoir may be removed, replaced and/or refilled.

The inkjet printhead assembly 112 is mounted relative to the housing 120 to define a print zone 119 adjacent to the printhead nozzles 31 in an area which is to receive the media sheet M. The media sheet M is moved into the print zone 119 by the media transport assembly 118. The mounting assembly 116 positions the printhead assembly 112 relative to the media transport assembly 118. For a scanning type inkjet printhead assembly, the mounting assembly 116 includes a carriage for moving the printhead assembly 112 relative to a media transport path to scan the printhead assembly 112 relative to the media sheet. For a non-scanning type inkjet printhead assembly, the mounting assembly 116 fixes the inkjet printhead assembly 112 at a prescribed position along the media transport path.

The electronic controller 122 receives documents, files or other data 121 to be printed from a host system, such as a computer. Typically, a print job is sent to the inkjet printing system 100 along an electronic, infrared, optical or other information transfer path. The print job includes data and one or more commands or command parameters. The electronic controller 122 includes memory for temporarily storing the data. The electronic controller 122 provides timing control for firing respective inkjet nozzles 31 to define a pattern of ejected ink drops which form characters, symbols or other graphics on the media sheet M. The pattern is determined by the print job data and print job commands or command parameters.

Upon activation of a given firing resistor 40 (see FIG. 2), ink within the surrounding nozzle chamber 42 is ejected through the nozzle opening 46 onto a media sheet M. The electronic controller 122 selects which firing resistors 40 are active at a given time by activating corresponding drive signals to heat the corresponding firing resistors 40. In one embodiment logic circuits and drive circuits forming a portion of the controller 122 are mounted to the substrate 34 of the printhead assembly 112. In an alternative embodiment logic circuitry and drive circuitry are located off the printhead assembly 112.

Meritorious and Advantageous Effects

One advantage of the invention is that pillars form a barrier 'reef' which keep particles away from ink feed holes of nozzle chambers. Thus, fluid is able to flow into the nozzle chambers even in the presence of particles. Another advantage of the pillars is that ink drop weight is substantially unaffected and overshoot during refill is slightly reduced.

Figure 7:
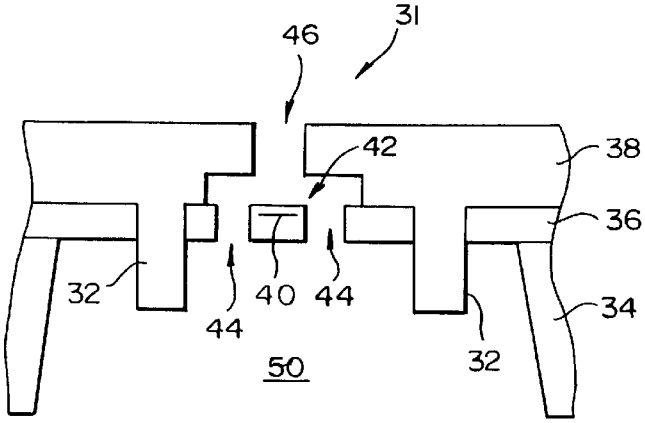
FIG. 7 is a planar view of a fabricated substrate portion after etching a trench and revealing the pillars.

Although a preferred embodiment of the invention has been illustrated and described, various alternatives, modifications and equivalents may be used. For example, although the trench 50 is shown in FIGS. 8–10 as being etched through the substrate 34 to the thin film structure 34 with the pillars 32, 32" formed adjacent to the thin film structure 34, the trench 50 need not be etched all the way through the substrate 34, as shown in FIG. 12. For example, the pillars 32 may be formed adjacent to the remaining substrate material using the methods described above for FIGS. 8–10. Similarly, the trench 50 of FIGS. 2 and 7 not be etched all the way through the substrate 34. In such embodiment the pillars 32 and openings 44 extend through the thin film structure 36 and an underlying portion of the substrate 34, which defines the floor/roof of the trench 50. Similarly, the trench 50 of FIG. 23 not be etched all the way through the substrate 34. In such embodiment the pillars 32" and openings 44 extend through the thin film structure 36 and an underlying portion of the substrate 34, which defines the floor/roof of the trench 50. Therefore, the foregoing description should not be taken as limiting the scope of the inventions which are defined by the appended claims.

What is claimed is:

1. A method to form pillars for a printhead comprising:

applying a thin film structure to a substrate;

etching a plurality of openings through the thin film structure and into the substrate;

applying a top layer to the thin film structure at a surface of the thin film structure opposite the substrate, wherein the plurality of openings through the thin film structure and into the substrate are filled with material of the top layer; and etching the substrate at a surface of the substrate opposite the thin film structure, wherein the top layer material that filled the plurality of openings is uncovered to form a plurality of pillars.

2. The method of claim 1 where the top layer is an orifice layer, the method further comprising forming a nozzle chamber in the orifice layer.

3. The method of claim 1, wherein etching the substrate includes etching a trench into the substrate at the substrate surface opposite the thin film structure, and wherein the plurality of pillars formed are located within the trench.

4. The method of claim 3, further comprising flowing ink into the trench and through an inlet opening into the nozzle chamber to refill a nozzle chamber.

5. The method of claim 4, further comprising blocking, with at least one of the plurality of pillars, a particle carried by the ink, wherein the particle is kept away from the inlet opening allowing ink to flow into the nozzle chamber.

6. The method of claim 1, in which etching a plurality of openings includes etching an inlet opening through the thin film structure, and etchings a plurality of pillar openings into the substrate.

7. The method of claim 6, in which etching an inlet opening includes etching an inlet opening through the thin film structure into the substrate, and in which etching the substrate includes etching a trench less than all the way through the substrate exposing the inlet opening.

8. The method of claim 6, in which etching a plurality of pillar openings into the substrate includes etching a pillar opening into the substrate in an area within the inlet opening, and wherein etching the substrate includes forming a pillar through the thin film and the substrate.

9. The method of claim 1 wherein the top layer is an etchant-resistant material that forms the plurality of pillars.

* * * * *